US010758753B2

(12) United States Patent
Su et al.

(10) Patent No.: US 10,758,753 B2
(45) Date of Patent: Sep. 1, 2020

(54) DUCTING SYSTEM

(71) Applicant: Commonwealth Scientific and Industrial Research Organisation, Acton, Australian Capital Territory (AU)

(72) Inventors: Shi Su, Pullenvale (AU); Hua Guo, Pullenvale (AU); Xinxiang Yu, Pullenvale (AU)

(73) Assignee: Commonwealth Scientific and Industrial Research Organisation, Action, Australian Capital Territory (AU)

( * ) Notice: Subject to any disclaimer, the term of this patent is extended or adjusted under 35 U.S.C. 154(b) by 0 days.

(21) Appl. No.: 15/764,206

(22) PCT Filed: Oct. 27, 2016

(86) PCT No.: PCT/AU2016/051008
§ 371 (c)(1),
(2) Date: Mar. 28, 2018

(87) PCT Pub. No.: WO2017/070737
PCT Pub. Date: May 4, 2017

(65) Prior Publication Data

US 2018/0272165 A1 Sep. 27, 2018

(30) Foreign Application Priority Data

Oct. 30, 2015 (AU) ..... 2015904458

(51) Int. Cl.
*A62C 3/06* (2006.01)
*A62C 4/02* (2006.01)
(Continued)

(52) U.S. Cl.
CPC ..... *A62C 3/06* (2013.01); *A62C 4/02* (2013.01); *E21F 1/00* (2013.01); *E21F 7/00* (2013.01);
(Continued)

(58) Field of Classification Search
CPC ..... A62C 3/06; A62C 4/02; E21F 1/00; E21F 7/00; F23G 7/06; F23G 2208/10;
(Continued)

(56) References Cited

U.S. PATENT DOCUMENTS

2011/0132592 A1* 6/2011 Apple ..... E21B 41/00 166/53
2013/0340872 A1* 12/2013 Cork ..... E21F 1/04 138/37
2015/0238787 A1* 8/2015 Van Gelder ..... A62C 3/04 169/45

FOREIGN PATENT DOCUMENTS

CN 101589271 B 1/2012
CN 202876161 U 4/2013
(Continued)

OTHER PUBLICATIONS

International Search Report and Written Opinion corresponding to PCT/AU2016/051008, dated Dec. 21, 2016, nine pages.
(Continued)

*Primary Examiner* — Qingzhang Zhou
(74) *Attorney, Agent, or Firm* — Kilpatrick Townsend & Stockton LLP

(57) ABSTRACT

The present invention relates to a ducting system (100) for conveying a flow of a gaseous feed (110) comprising a combustible component from an inlet to at least one combustion module (12), the ducting system (100) utilising a combination of a sensor (C0) for measuring the concentration of the combustible component in the gaseous feed (110), a flame detector (F0, F1, F2, F3, . . . , Fn) a shut-off valve
(Continued)

(6) and a flame arrestor (5) located in a flow path of the gaseous feed upstream of the shut-off valve (6) such that a measurement of a concentration of combustible material in the gaseous feed over a specified concentration by the sensor (CO) causes the shut-off valve (6) to be configured to the closed position for preventing flow of a gaseous feed comprising a combustible mixture of the combustible component from reaching an ignition source and/or detection of flame by the flame detector (F0, F1, F2, F3, . . . , Fn) causes shut-off valve (6) to be configured to the closed position for attenuating propagation of a flame towards the inlet.

17 Claims, 6 Drawing Sheets

(51) Int. Cl.

| | |
|---|---|
| ***E21F 7/00*** | (2006.01) |
| ***F23N 5/24*** | (2006.01) |
| ***F23G 7/06*** | (2006.01) |
| ***E21F 1/00*** | (2006.01) |

(52) U.S. Cl.
CPC ..... *F23G 7/06* (2013.01); *F23N 5/24* (2013.01); *F23G 2204/103* (2013.01); *F23G 2208/10* (2013.01); *F23G 2209/141* (2013.01); *F23N 2231/28* (2020.01)

(58) Field of Classification Search
CPC ..... F23G 2209/141; F23G 2204/103; F23N 5/24; F23N 7/00; F23N 2031/28
See application file for complete search history.

(56) References Cited

FOREIGN PATENT DOCUMENTS

| | | | | |
|---|---|---|---|---|
| CN | 202914127 | U | | 5/2013 |
| CN | 204201939 | | * | 3/2015 |
| CN | 204201939 | U | | 3/2015 |
| CN | 204457839 | U | | 7/2015 |
| EP | 2825286 | A1 | | 1/2015 |
| WO | PCT/AU2009/001708 | A1 | | 12/2009 |

OTHER PUBLICATIONS

First Office Action for Chinese Application No. 201680062706.8 dated Mar. 4, 2020, all pages.

* cited by examiner

DUCTING SYSTEM

CROSS-REFERENCE TO RELATED APPLICATIONS

The present application claims priority from Australian Provisional Patent Application No 2015904458 filed on 30 Oct. 2015, the content of which is incorporated herein by reference.

TECHNICAL FIELD

The present invention relates to a ducting system for a gaseous feed comprising a combustible component, and more particularly for a ducting system for conveying coal mine ventilation air comprising methane to at least one combustion module.

BACKGROUND

It is often desirable to mitigate a component or components from a fluid stream, particularly where the fluid stream is a gaseous emission from a process which contains compounds which are harmful to humans and/or the environment. Examples of such compounds include volatile hydrocarbons such as methane ($CH_4$). Fugitive methane emissions occur from a variety of sources including coal, oil and gas production, transport, mining, agriculture, waste disposal, livestock, waste water treatment and land use (forestry).

Current data indicates that, of the anthropogenic gases that contribute to global warming, methane ($CH_4$) is the most significant after carbon dioxide ($CO_2$). On a unit basis, $CH_4$ is estimated to be 25 times more potent at trapping heat in the atmosphere than $CO_2$ over a 100 year period. While methane originates from several sources, fugitive $CH_4$ emissions from coal mines represent approximately 8% of the world's anthropogenic $CH_4$, and contribute roughly 17% to anthropogenic emissions. Coal mine methane (CMM) is not only a greenhouse gas but also represents a significant wasted energy resource which, under certain conditions, could be effectively used for electrical generation, heating or chemical manufacturing feedstock. It was estimated that about 28 billion $m^3$ of $CH_4$ (equivalent to 420 million tonnes of $CO_2$) are emitted annually to the atmosphere from coal mining activities around the world in 2010.

Depending on coal mine site specifications, approximately 50-85% of all coal mining related methane is emitted to the atmosphere in mine ventilation air. The development of technologies for ventilation air methane (VAM) capture, mitigation and utilisation are on-going challenges because the ventilation air volume flow rate is large and the methane concentration is dilute and variable. A typical gassy mine in Australia produces ventilation air at a rate of approximately 120 to 600 $m^3/s$ with methane concentrations of 0.3-1%.

Existing technologies used to mitigate methane from mine ventilation air include a range of techniques such as techniques based on methane oxidation and adsorption. In methane oxidation systems, a gaseous feed containing methane is introduced to a combustion module where the gaseous feed is heated. When the gaseous feed reaches the auto-ignition temperature of methane, oxidation of the methane takes place. The reaction can be classified as either thermal oxidation occurring at temperatures in the order of 850-1300° C., or catalytic oxidation occurring at temperatures in the order of 450-800° C.

For mine site application, ventilation air is conveyed to VAM combustion modules through a ducting system (either unenclosed or enclosed) from the mine ventilation air shaft. Enclosed ducting is required to capture the full ventilation air flow. Whether ducting is unenclosed or enclosed, an unplanned event, e.g. the release of a pocket of higher concentration methane into the ventilation air, could result in an explosive mix of methane which is directly ducted to a potential ignition source in the methane combustion modules.

For combustion to occur, the level of a combustible gas must be between its Lower Explosive Limit (LEL) and Upper Explosive Limit (UEL). The upper and lower explosive limits are defined as the lowest concentration (by percentage) of a gas or vapour in air that is capable of producing a flash of fire in the presence of an ignition source. For methane and air mixtures, the LEL is 5% $CH_4$ and the UEL is 15% $CH_4$. In the event that a combustible gas at levels in the LEL to UEL range comes into contact with an ignition source, combustion may occur. In general, there are two important regimes of combustion: deflagration and detonation.

Deflagration is characterised by a subsonic flame front velocity. The main mechanism of combustion propagation is of a flame that propagates due to heat transfer effects. Detonation is characterised by a supersonic flame front velocity which propagates due to a powerful pressure wave that compresses the unburnt gas ahead of the wave to a temperature above the auto-ignition temperature. The effects of detonation on a confined system can be devastating.

In confined systems such as ducting, obstacles in the flame path such as elbows, sensors and other attachments can cause turbulence in the flame, thus accelerating a subsonic flame (deflagration) to a supersonic speeds (detonation). The transition from a deflagration type of combustion to a detonation type of combustion is known as the deflagration to detonation transition (DDT).

Due to the presence of combustible methane in ventilation air, when any VAM technologies with a potential ignition source are commercially implemented at mines, a major concern faced by the coal industry is the safety of connecting the VAM combustion modules to the mine ventilation air shaft. Existing ducting systems for commercial scale VAM combustion modules operating at coal mines rely on prevention methods utilising monitoring and mechanically operated safety features. However, these existing prevention measures can be unsuccessful as the failure of any one of the monitoring and mechanically operated safety features can render the entire fire prevention system useless. Furthermore, faulty prevention measures can act as an ignition source in the system which could result in the ignition of the combustible component they were aimed at preventing.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

SUMMARY

Throughout this specification the word "comprise", or variations such as "comprises" or "comprising", will be understood to imply the inclusion of a stated element, integer or step, or group of elements, integers or steps, but not the exclusion of any element, integer or step, or group of elements, integers or steps.

According to a first aspect of the present invention, there is provided a ducting system for conveying a flow of a gaseous feed comprising a combustible component from an inlet to at least one combustion module, the system comprising:

a shut-off valve configurable to have an open position to allow the flow of the gaseous feed from the inlet to the at least one combustion module and a closed position to prevent the flow of the gaseous feed from the inlet to the at least one combustion module;

a sensor to measure a concentration of the combustible component in the flow of the gaseous feed, the sensor located upstream of the shut-off valve;

a flame detector located downstream of the shut-off valve;

a flame arrestor located in a flow path of the gaseous feed upstream of the shut-off valve; and a source of fire retardant and a fire retardant valve feeding one or more fire retardant injection points for controlling flow of the fire retardant into the ducting system, the one or more fire retardant injection points positioned between the flame arrestor and the at least one combustion module, wherein the shut-off valve is operatively associated with the sensor such that a measurement of a concentration of the combustible component in the gaseous feed over a specified concentration by the one sensor causes the shut-off valve to be configured to the closed position for preventing flow of a gaseous feed comprising a combustible mixture of the combustible component from reaching an ignition source, wherein the shut-off valve is operatively associated with the flame detector such that detection of flame by the flame detector causes the shut-off valve to be configured to the closed position for attenuating propagation of a flame toward the inlet, and wherein the fire retardant valve is operatively associated with the flame detector such that detection of flame by the flame detector causes the fire retardant valve to open allowing the fire retardant to flow into the ducting system for attenuating the detected flame.

As ancillary equipment such as the shut-off valve, when faulty, may act as an ignition source, the flame arrestor is located upstream of any potential ignition sources. However, as this may be located some distance from the combustion modules, another potential source of ignition, the likelihood of a flame originating at the combustion modules has an increased likelihood of undergoing DDT. This likelihood further increases with the presence of turbulence inducing features along the ducting. As such, the flame arrestor positioned upstream of the shut-off valve may be a detonation rated flame arrestor.

The flame arrestor in the flow path of the gaseous feed upstream of the shut-off valve may act to attenuate propagation of a flame between a source of ignition, such as the combustion modules, and the inlet should any one of the fire prevention measures fail and ignition of the gaseous feed were to occur. The shut-off valve in combination with the sensor may act to prevent combustion of the gaseous feed occurring by preventing a portion of the feed containing a combustible mixture of the combustible component from reaching potential ignition sources such as the combustion modules. In addition, the shut-off valve in combination with the flame detector may act to attenuate combustion by providing a barrier to a flame front propagating toward the inlet.

The fire retardant injection points are preferably positioned between the flame arrestor and the one or more combustion modules. While flame arrestors are typically positioned in close proximity to potential sources of ignition, the addition of the fire retardant injection points downstream of the flame arrestors have been found to advantageously inhibit the severity of the flame propagation front, thereby enabling a lower rated flame arrestor to be used or further enhancing the flame arresting. Indeed, the strategy of multiple flame prevention measures in co-operation with multiple flame attenuation measures enables the required safety requirements to be met without having to rely upon a few highly rated protection devices, which may be difficult to replace or repair, with the consequence of device failure often catastrophic.

Preferably, the sensor is located between the inlet and the shut-off valve at a position such that the shut-off valve can be configured to the closed position prior to a portion of the gaseous feed, comprising the combustible component at a concentration over the specified concentration as measured by the first sensor, flowing to the shut-off valve. It will be appreciated that the further the sensor is positioned from the shut-off valve, the more time there is for the shut-off valve to operate prior to the portion of the gaseous feed flowing from the sensor to the shut-off valve. Preferably the sensor positioned at least 50 m, more preferably 100 m, upstream of the shut-off valve. Most preferably, the sensor is positioned at the furthest available distance from the shut-off valve, for example adjacent the source of the gaseous feed. The further the distance between the sensor and the shut-off valve the greater time the sensor has to activate the flame retardant mechanisms downstream to avoid or lessen the impact of potential fire or explosion and resultant flash or burn back.

The at least one combustion module is preferably shut down to remove the combustion module as a potential ignition source upon measurement of a concentration of the combustible component in the flow of the gaseous feed over the specified concentration by the at least one sensor and/or detection of flame by the flame detector.

The ducting system may be for use with a plurality of combustion modules, the system further comprising a plurality of combustion module pipes, wherein each combustion module is in fluid communication with a respective combustion module pipe. Preferably, each combustion module pipe comprises a combustion module inlet valve and a flame detector positioned between the combustion module and the combustion module inlet valve.

Each combustion module pipe may comprise:

the flame detector;

the shut-off valve; and the flame arrestor located upstream of the shut-off valve.

Each combustion module pipe may comprise a supplementary sensor to measure a concentration of the combustible component in the flow of the gaseous feed, wherein a combustion module may be shut down upon measurement of a concentration of the combustible component in the flow of the gaseous feed over the specified concentration and/or detection of flame at the respective combustion module pipe.

As the combustion modules present a potential ignition source, a combustion module flame arrestor is preferably positioned proximal to each of the at least one combustion modules. By positioning a combustion module flame arrestor close to the ignition source can minimise the potential distance of travel of a flame originating at the combustion module which decreases the likelihood of the flame undergoing a deflagration to detonation transition (DDT). As such, the combustion module flame arrestors positioned proximal to the combustion modules may be a deflagration rated flame arrestor.

The flame arrestor may be any suitable flame arrestor, for example the flame arrestor may be selected from crimped metal ribbon, parallel plate, expanded metal cartridge, perforated plate, wire gauze, sintered metal, metal shot, ceramic balls and/or compressed wire wool flame arrestor elements.

In certain embodiments, the flame arrestor comprises a crimped metal ribbon flame arrestor element. The flame arrestor may also comprise two or more crimped metal ribbon flame arrestor elements in series or in parallel.

It will be appreciated that the dimensions and characteristics of the crimped metal ribbon flame arrestor elements may be selected based on a number of factors such as pipe diameter, gas flow rate and gas composition. Further considerations may include the position of the flame arrestor relative to potential ignition sources, and the types, quantity and position of flame attenuation measures positioned between potential ignitions sources and the flame arrestor. The inventors have found that the configurations of flame attenuation measures described in the present invention to be particularly effective when working in co-operation with the flame arrestor, such that there is greater design freedom in the type, size and positioning of the flame arrestor.

Preferably, the crimped metal ribbon flame arrestor element has an expansion ratio greater than about 1, preferably from about 1 to about 5, and more preferably about 2. The crimped metal ribbon flame arrestor element path length may be of any suitable length, preferably from about 10 mm to about 250 mm. Optionally, the at least one crimped metal ribbon flame arrestor element comprises at least one support member 231 extending radially through the crimped metal ribbon flame arrestor element.

The system may further comprise a first source of fresh air and a first fresh air valve for controlling flow of the first source of fresh air into the system. The first fresh air valve may be operatively associated with the shut-off valve such that when the shut-off valve is configured to the closed position, the first fresh air valve is in an open position to allow flow of fresh air into the system for diluting the concentration of the combustible component.

The one or more fire retardant injection points preferably define a fire retardant injection zone in the ducting system. The fire retardant injection zone is preferably from 1 to 100 m in length, more preferably the injection zone is from 5 to 50 m in length. The fire retardant may be any suitable fire retardant for attenuating flame. For example the fire retardant may be a fluid, e.g. a liquid such as water or a gas such as an inert gas. In a preferred form, the fire retardant is carbon dioxide. Preferably, at least one fire retardant injection point is positioned upstream of the shut-off valve and at least one fire retardant injection point is positioned downstream of the shut-off valve.

Preferably, the system further comprises one or more burst panels located upstream of the at least one combustion module. More preferably, the one or more burst panels are used in co-operation with the one or more fire retardant injection points. In such embodiments, the one or more burst panels are preferably positioned downstream of the fire retardant injection points. In this configuration, activation of the flame detector causes the flame retardant to be injected into the duct, thereby increasing the duct pressure and activation the burst panel earlier than if the flame retardant was not injected into the duct. Furthermore, positioning of the burst panels downstream of the flame arrestor enables that the activation of the burst panel prevents damage to upstream devices.

The system may further comprise a supplementary gaseous feed comprising a supplementary combustible component and a supplementary gaseous feed valve for controlling flow of supplementary gaseous feed into the flow of the gaseous feed downstream of the shut-off valve. The supplementary gaseous feed is preferably in fluid communication with a gas mixer for mixing the gaseous feed with the supplementary gaseous feed whereby the supplementary gaseous feed is fluidly connected to the mixer by a supplementary gaseous feed pipe, the pipe comprising one or more of: the supplementary gaseous feed valve, a fuel filter, a fuel flame arrestor, a fuel check valve, a fuel pressure regulator and/or one or more fuel valves. The system may further comprise a supplementary gaseous feed flow monitor and controller.

The system may further comprise a second source of fresh air and a second fresh air valve for controlling flow of the second source of fresh air into the flow of the gaseous feed at a position upstream of the mixer. Preferably, the system further comprises a pair of supplementary sensors to measure a concentration of the combustible component in the flow of the gaseous feed, wherein the supplementary sensors are positioned upstream and downstream of the mixer, respectively, and wherein the supplementary sensors are operatively associated with the second fresh air valve and the supplementary gaseous feed valve for controlling the concentration of the combustible component in the flow of the gaseous feed leaving the mixer.

The gaseous feed may be ventilation air derived from a coal mine and the volatile component is methane. Where methane is the combustible gas, the specified concentration is preferably below the lower explosive limit for methane, and more preferably the specified concentration is 1.25%. Preferably, the system further comprises a ventilation air filter for filtering coal dust from the ventilation air. The ventilation air filter is preferably positioned upstream relative to the flame arrestor.

According to a second aspect of the present invention, there is provided a ducting system for conveying a flow of a gaseous feed comprising a combustible component from an inlet to at least one combustion module, the system comprising:

a sensor for measuring a concentration of the combustible component in the flow of the gaseous feed;

a flame detector;

a shut-off valve configurable to have an open position to allow the flow of the gaseous feed from the inlet to the at least one combustion module and a closed position to prevent the flow of the gaseous feed from the inlet to the at least one combustion module; and a flame arrestor located in a flow path of the gaseous feed upstream of the shut-off valve, wherein the shut-off valve is operatively associated with the sensor such that a measurement of a concentration of the combustible component in the gaseous feed over a specified concentration by the one sensor causes the shut-off valve to be configured to the closed position for preventing flow of a gaseous feed comprising a combustible mixture of the combustible component from reaching an ignition source; and wherein the shut-off valve is operatively associated with the flame detector such that detection of flame by the flame detector causes the shut-off valve to be configured to the closed position for attenuating propagation of a flame toward the inlet.

According to a third aspect of the present invention, there is provided a ducting system for conveying a flow of a gaseous feed comprising a combustible component from an inlet to at least one combustion module, the system comprising:

a shut-off valve configurable to have an open position to allow the flow of the gaseous feed from the inlet to the at least one combustion module and a closed position to prevent the flow of the gaseous feed from the inlet to the at least one combustion module;

a sensor to measure a concentration of the combustible component in the flow of the gaseous feed, the sensor located upstream of the shut-off valve;

a flame detector located downstream of the shut-off valve;

a flame arrestor located in a flow path of the gaseous feed upstream of the shut-off valve;

a source of fire retardant and a fire retardant valve feeding one or more fire retardant injection points for controlling flow of the fire retardant into the ducting system, the one or more fire retardant injection points positioned between the flame arrestor and the at least one combustion module;

a supplementary gaseous feed in fluid communication with a gas mixer for mixing the gaseous feed with the supplementary gaseous feed, the supplementary gaseous feed comprising a supplementary combustible component;

a supplementary gaseous feed valve for controlling flow of supplementary gaseous feed into the flow of the gaseous feed downstream of the shut-off valve;

a source of fresh air and a fresh air valve for controlling flow of the source of fresh air into the flow of the gaseous feed at a position upstream of the mixer; and a pair of supplementary sensors to measure a concentration of the combustible component in the flow of the gaseous feed, the supplementary sensors positioned upstream and downstream of the mixer, respectively, wherein the shut-off valve is operatively associated with the sensor such that a measurement of a concentration of the combustible component in flow of the gaseous feed over a specified concentration by the sensor causes the shut-off valve to be configured to the closed position for preventing flow of a gaseous feed comprising a combustible mixture of the combustible component from reaching an ignition source, wherein the shut-off valve is operatively associated with the flame detector such that detection of flame by the flame detector causes the shut-off valve to be configured to the closed position for attenuating propagation of a flame toward the inlet, wherein the fire retardant valve is operatively associated with the flame detector such that detection of flame by the flame detector causes the fire retardant valve to open allowing the fire retardant to flow into the ducting system for attenuating the detected flame, and wherein the supplementary sensors are operatively associated with the second fresh air valve and the supplementary gaseous feed valve for controlling the concentration of the combustible component in the flow of the gaseous feed leaving the mixer.

It will be appreciated that additional features described for the first aspect above may also form additional features of this second and third aspects where appropriate.

According to a fourth aspect, there is provided a system for mitigating methane from coal mine ventilation air comprising:

a ducting system according to any one of the first, second or third aspects; and a plurality of combustion modules in fluid communication with the ducting system.

In some embodiments, the combustion modules may include a body portion formed from a refractory material and having a plurality of bores extending therethrough, the bores facilitating the flow of the gaseous feed through the body portion and transfer of heat to the gaseous feed.

Preferably, the bores are substantially parallel to one another and have a width of from about 1 mm to about 10 mm, are spaced apart a distance of from about 2 mm to about 25 mm from the centre points of the bores, and the body portion has a height, width and depth each from about 1 m to about 3 m.

The refractory material may be selected from a ceramic material, alumina, silica, magnesia, lime, fireclays, zirconia, dolomite, mullite, castable refractory cement and mixtures thereof.

The body portion may be heated to a temperature of from about 900° C. to about 1200° C.

Alternatively, the body portion may include at least one catalyst disposed on internal wall of the bores, or disposed in the refractory material, and the body portion may then only be required to be heated to a temperature of from about 200° C. to about 700° C.

In other embodiments, the combustion modules may include a body portion in the form of a honeycomb-type monolith catalytic combustor. The catalytic combustor may contain any suitable catalyst for the system, for example a catalyst having an activity of $50\times10^{-7}$ to $200\times10^{-7}$ mole/m$^2$s and a reaction surface area of 20 to 40 m$^2$/cm$^2$. The honeycomb-type monolith catalytic combustor may comprise a ceramic monolith which acts as a substrate for a wash coat slurry of base metals on which a noble metal catalyst is placed.

BRIEF DESCRIPTION OF DRAWINGS

Embodiments of the present invention will now be described, by way of example only, with reference to the accompanying drawings, in which.

DESCRIPTION OF EMBODIMENTS

Figure 1:
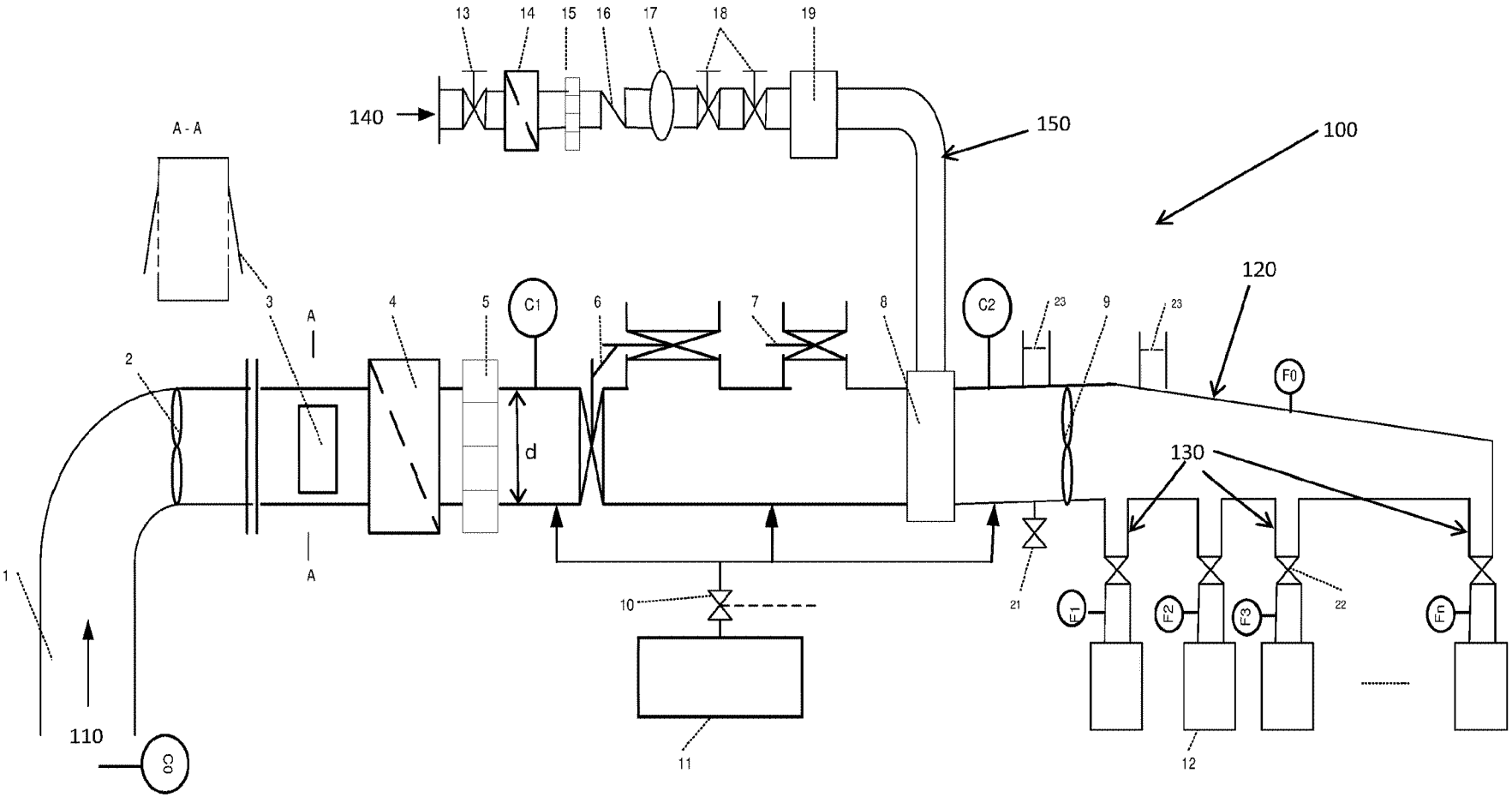
FIG. 1 is a schematic diagram of a first configuration of a ducting system according to the invention.

Referring initially to FIGS. 1 to 4, where like features have been given like numbers, there is provided a number of configurations of a ducting system 100 for conveying flow of a gaseous feed 110 such as coal mine ventilation air having a combustible component in the form of methane. The ducting system 100 allows a flow of gaseous feed 110 from an inlet (not shown) to a plurality of combustion modules 12.

As used herein, upstream refers to a position situated in the opposite direction to the direction of flow of the gaseous feed (i.e. towards the inlet) and downstream refers to a position situated in the same direction as the direction of flow of the gaseous feed (i.e. towards the combustion modules 12).

In each configuration, the ventilation air 110 flows from the inlet (not shown), through the ventilation air shaft 1 and past a sensor C0 for measuring a concentration of methane in the ventilation air. A shut-off valve 6 is operatively associated with the sensor C0 such that a measurement of methane above a specified concentration by the sensor C0 causes the shut-off valve 6 to be configured to a closed position preventing further flow of the gaseous feed 110 toward potential ignition sources such as the combustion modules 12.

As shown in FIGS. 1 to 4, the sensor C0 is positioned upstream of the shut-off valve 6. It is preferred that the first sensor C0 is positioned as far underground as possible, i.e. as close to the source of the ventilation air as possible. By locating the first sensor C0 as far from the shut-off valve 6 as possible, the earlier a pocket of gas containing a potentially combustible concentration of methane entering the system 100 can be detected and preventative measures such as closing shut-off valve 6 and shutting down the combustion units 12 can be implemented.

A pair of supplementary sensors C1 and C2 for measuring the concentration of methane in the flow of the ventilation air are also provided. In addition to monitoring for potentially combustible concentrations of methane, which also triggers the closure of shut-off valve 6 and shut down of the combustion modules 12 as described in relation to the sensor C0 above, the supplementary sensors C1 and C2 assist in maintaining the concentration of methane in preferred operational limits for mitigation by the combustion units 12.

The supplementary sensors C1 and C2 are positioned upstream and downstream, respectively, of a mixer 8. A supplementary gaseous feed 140 comprising methane is provided in fluid communication with the mixer 8. The supplementary sensors C1 and C2 are operatively associated with a fresh air valve 7 and a supplementary gaseous feed valve 13 for controlling the concentration of the methane in the flow of the ventilation air leaving the mixer 8.

The combination of the sensors C0, C1, C2 and the shut off valve 6 aim to prevent fire occurring by maintaining the concentration of methane below its lower explosive limit and, where a measurement of the concentration of methane above a specified value is detected, preventing flow of the ventilation air comprising a potentially combustible mixture of methane from flowing towards potential ignition sources such as the combustion modules 12. However, in the event that the preventative measures should fail, the ducting system 100 is further provided with measures, as described below, for attenuating a flame should ignition of the ventilation air occur.

Flame detectors F0, F1, F2, F3, . . . , Fn are provided downstream of the shut-off valve 6. The flame detectors F0, F1, F2, F3, . . . , Fn are shown positioned adjacent each combustion unit 12, however it will be appreciated that additional flame detectors F0, F1, F2, F3, . . . , Fn may be positioned adjacent any ancillary equipment that may present as a potential ignition source. The shut-off valve 6 is operatively associated with the flame detectors F0, F1, F2, F3, . . . , Fn such that detection of a flame by any one of the flame detectors F0, F1, F2, F3, . . . , Fn to be configured to a closed position thereby providing a barrier to the flame from propagating toward the inlet.

A source of fire retardant 11 and a fire retardant valve 10 for controlling the flow of fire retardant into the system may also be provided. The fire retardant valve 10 is operatively associated with the flame detectors F0, F1, F2, F3, . . . , Fn such that detection of flame by the flame detector F0, F1, F2, F3, . . . , Fn causes the fire retardant valve 10 to open allowing fire retardant to flow into the ducting system at one or more fire retardant injection points defining a fire injection zone for attenuating the detected flame. For example, the fire retardant is configured to flow into the system at fire retardant injection points on both sides of the shut-off valve 6 such that, as the detection of the flame by the flame detectors F0, F1, F2, F3, . . . , Fn causes the shut-off valve 6 to close, the fire retardant would be prevented from flowing to sections on either side of the shut-off valve 6. Furthermore, the fire retardant is preferably configured to flow into the ducting system 100 at fire retardant injection points upstream of potential ignition sources to provide additional time from the detection of a flame for the fire retardant to flow into the ducting system 100.

Burst panels 23 are further provided between the fire retardant injection points and the combustion modules for releasing the pressure inside the ducting in the event of fire or an explosion. In the event of a flame detection by the flame detectors F0, F1, F2, F3, . . . , Fn, shut-off valve 6 closes and fire retardant valve 10 opens allowing fire retardant to flow into the ducting system downstream of the shut-off valve. The introduction of fire retardant and closure of the shut-off valve may lead to an increase in pressure in the portion of the ducting downstream of the shut-off valve. This increase in pressure may be as a result of the flame propagation, the introduction of pressurised fire retardant and the reaction between the flame and the fire retardant (e.g. heating of a gas fire retardant or vapourisation of a liquid fire retardant such as water). This increase in pressure leads to a bursting of the burst panels 23 which protects this portion of the duct from deformation and provides a low pressure path for the flame to be directed outside of the ducting system 100.

A flame arrestor 5, described in more detail below, is further provided upstream of any potential ignition sources including the shut-off valve 6. Any flame that progresses through the above described flame attenuation measures comes into contact with the flame arrestor for further attenuation. It will be appreciated that, in the event that the above measures fail to quench the flame entirely, the flame will be greatly attenuated relative to a system not including such measures.

As the combustion modules 12 present a potential ignition source, additional flame arrestors may be provided in close proximity to the combustion modules 12, for example between the combustion module 12 and the combustion module inlet valve 22. Positioning a flame arrestor close to an ignition source can minimise the potential distance of travel of a flame originating at the combustion module 12 which decreases the likelihood of the flame undergoing a deflagration to detonation transition (DDT). As such, any flame arrestor positioned between the combustion module 12 and the combustion module inlet valve 22 may be a deflagration rated flame arrestor. The presence of a flame arrestor in proximity to the combustion modules may also reduce the physical requirements of the flame arrestor 5 positioned upstream of the shut-off valve 6.

Specific configurations of the ducting system 100 will now be described with reference to FIGS. 1 to 4.

Configuration 1

Referring to FIG. 1, a fully enclosed ducting system 100 is provided comprising a ventilation air fan 2 for conveying the flow of coal mine ventilation air 110 containing the combustible component methane from the ventilation air shaft 1 through a main duct 120 to a plurality of ventilation air methane (VAM) combustion modules 12, where each VAM combustion module 12 is fluidly connected to the main duct via a respective combustion module pipe 130.

From the ventilation air shaft 1, the coal mine ventilation air 110 passes through a ventilation air filter 4 for filtering coal dust from the ventilation air and a flame arrestor 5. The flame arrestor 5 may be any suitable flame arrestor, for example a crimped metal ribbon flame arrestor 300 of the type shown in FIGS. 5 and 6 and as discussed in more detail below. By locating the flame arrestor 5 in a flow path of the coal mine ventilation air 110, this may attenuate propagation of a flame between the combustion module 12 and the inlet. This may be advantageous should other fire prevention measures fail and ignition of the coal mine ventilation air 110 in the system 100 were to occur.

A three-way butterfly valve 6 is provided such that, when operated, simultaneously stops the flow of ventilation air 110 toward the VAM combustion modules 12 and opens a valve to allow a flow of fresh air into the system thereby to dilute the concentration of methane in the flow of the ventilation air 110. The three-way butterfly valve 6 is operated in the event of the detection of a concentration of methane above a specified value by any one of the methane sensors C0, C1, C2 located throughout the ducting system, or the detection of flame by any one of the number of flame detectors F0, F1, F2, F3, . . . , Fn. The three-way butterfly valve 6 may be automatically operated after receiving a control signal from a controller (not shown), which may provide the control signal in response to sensor signals from methane sensors C0, C1, C2 and flame detectors F0, F1, F2, F3, . . . , Fn.

An additional fresh air supply is provided, with the flow of fresh air into the flow of ventilation air controlled by fresh air valve 7. During standard operation, when the methane concentration is required to be brought down by operational requirements of the downstream VAM combustion modules 12, the fresh air is sucked into the ventilation air by controlling the fresh air valve 7. The fresh air flow rate is controlled by the methane sensors C1 and C2. C1 is used to monitor the methane concentration in the ventilation air, and C2 for the methane concentration after the valve 7, i.e. the methane concentration in the flow of ventilation air 110 being conveyed to the VAM combustion modules 12.

When the methane concentration is required to be brought up to a certain level for the self-sustaining operation of the downstream VAM combustion modules, a supplementary gaseous feed 140 such as coal mine drainage gas is injected into the flow of ventilation air 110 through mixer 8. The supplementary gaseous feed 140 is supplied from a source through a supplementary gaseous feed pipe 150 comprising a supplementary gaseous feed valve 13, fuel filter 14, fuel flame arrestor 15, fuel check valve 16, fuel pressure regulator 17 and fuel valves 18. The flow rate of the supplementary gaseous feed 140 is monitored and controlled via a fuel flow monitor and controller 19. The supplementary gaseous feed 140 flow rate is determined by methane sensors C1 and C2. C1 is used to monitor the methane concentration in the flow of ventilation air upstream of mixer 8, and C2 for the methane concentration downstream of mixer 8, i.e. the methane concentration in the flow of ventilation air 110 being conveyed to the VAM combustion modules. The mixer 8 can be any type of mixer for mixing the supplementary gaseous feed 140 and flow of ventilation air 110, e.g. an array of fuel nozzles around the ventilation air ducting.

In the event of a methane reading by any one of the methane sensors C0, C1, C2 above the specified value, for example a value of 1.25%, the valve 6 will be operated to be closed to the flow of ventilation air 110 and open to the fresh air supply. In addition, the two fuel valves 18 will also be operated to close to ensure no additional methane is being introduced to the system, and the VAM combustion modules 12 are shut down. Valves 6, 18 and the VAM combustion modules 12 will be similarly operated in the event of any one of the flame detectors F0, F1, F2, F3, . . . , Fn detecting a flame.

In addition to the flame prevention measures discussed above, the ducting system also provides a number of measures for suppressing flame propagation should fire occur. One measure includes the provision of a flame arrestor 5, discussed in more detail below, in the flow path from the ventilation shaft 1 to the VAM combustion modules and an additional flame arrestor 15 in the supplementary gaseous feed pipe 150. In addition, a source of inert gas 11, for example compressed $CO_2$, is also provided with flow of $CO_2$ into the ducting system 100 controlled by inert gas valve 11. The inert gas valve 11 is configured to open in the event of a flame being detected by any one of the flame detectors F0, F1, F2, F3, . . . , Fn such that $CO_2$ flows into the main duct at various positions through an array of nozzles.

To avoid ventilation air fan 2 back pressure and shaft exit blockage when the ducting system is not operated correctly or in the case of emergency where the three-way butterfly valve 6 is closed to the flow of ventilation air 110, two gravity-based hanging doors 3 (one per side) can be used. The hanging doors 3 can be pushed open automatically by ventilation air pressure. When the ducting is in normal operation, and a pressure balance is achieved by the extraction fan 9, the hanging doors 3 are in a closed position. The selection of the cross-sectional area of the hanging doors 3 is dependent on the ventilation air flow rate and pressure.

One or more burst panels 23 are installed downstream of the mixer 8 to release the pressure inside the ducting if the explosion occurs. The burst panels 23 can be rated to 50 kPa or 100 kPa or other valve, and the use of burst panels 23 can reduce the required duct wall thickness. The size of the burst panels 23 is determined based on the duct size and gas flow rate in the duct.

A drainage valve 21 is also provided for draining any condensed water inside the ducting.

Configuration 2

Figure 2:
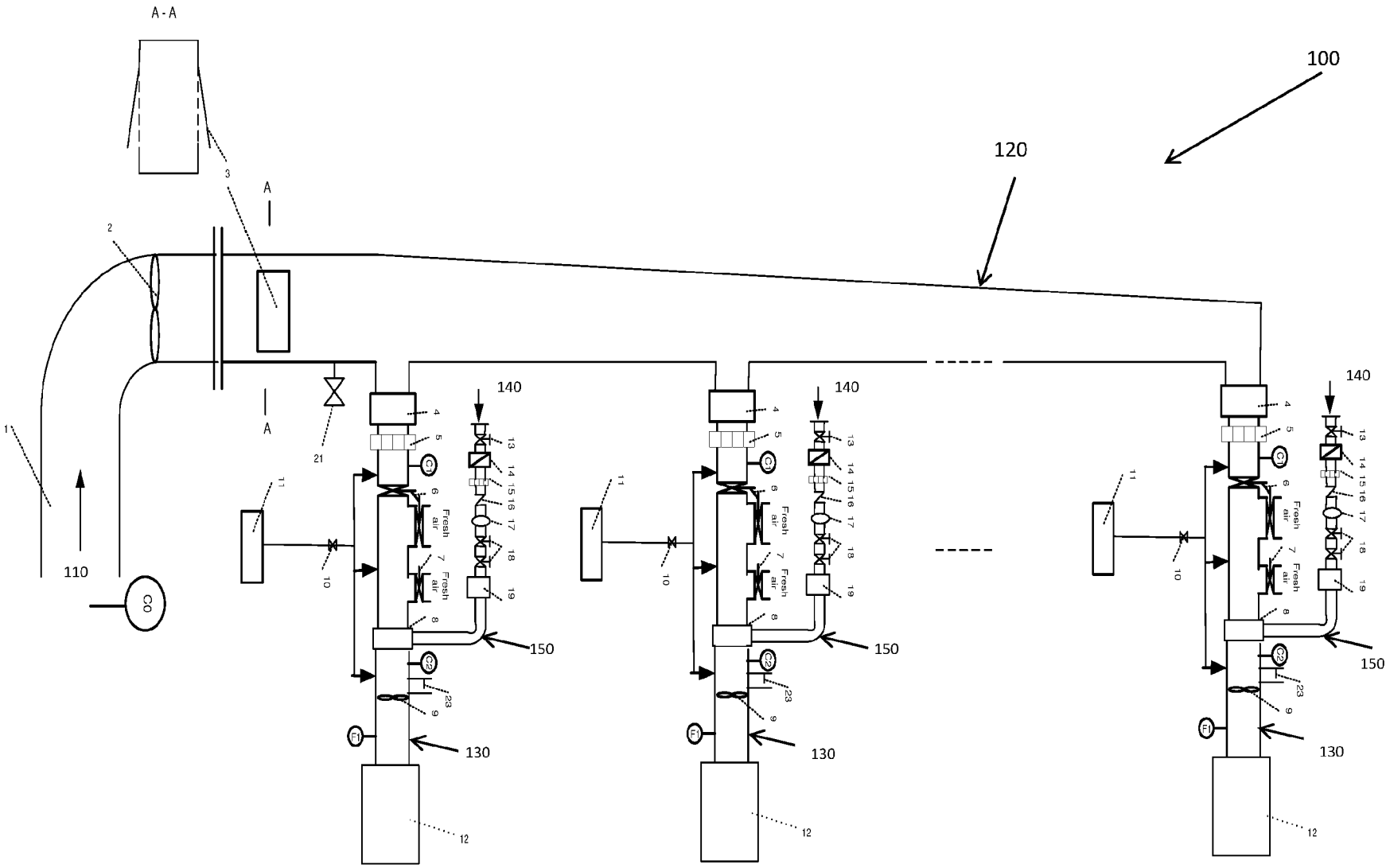
FIG. 2 is a schematic diagram of a second configuration of a ducting system according to the invention.
Figure 3:
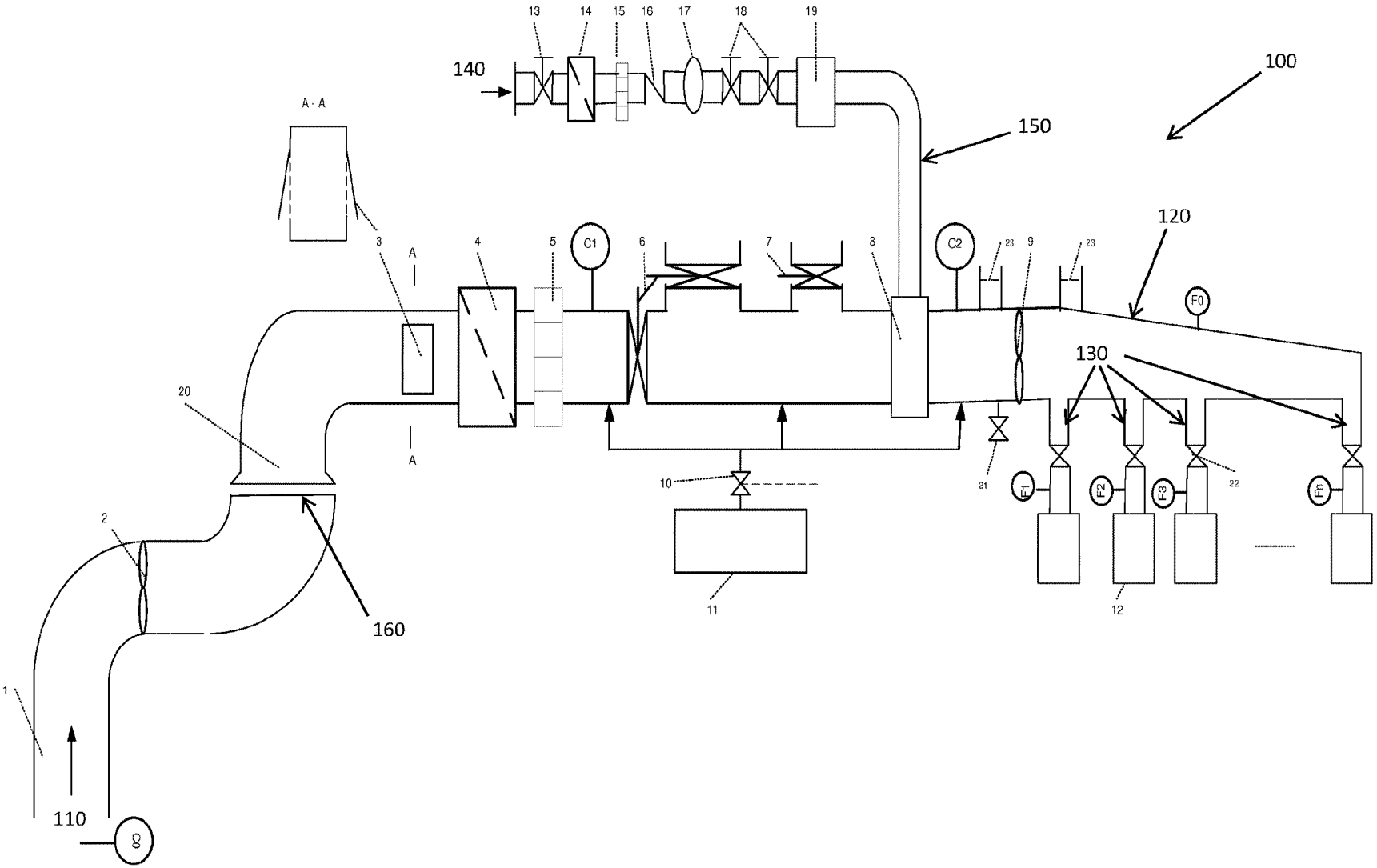
FIG. 3 is a schematic diagram of a third configuration of a ducting system according to the invention.
Figure 4:
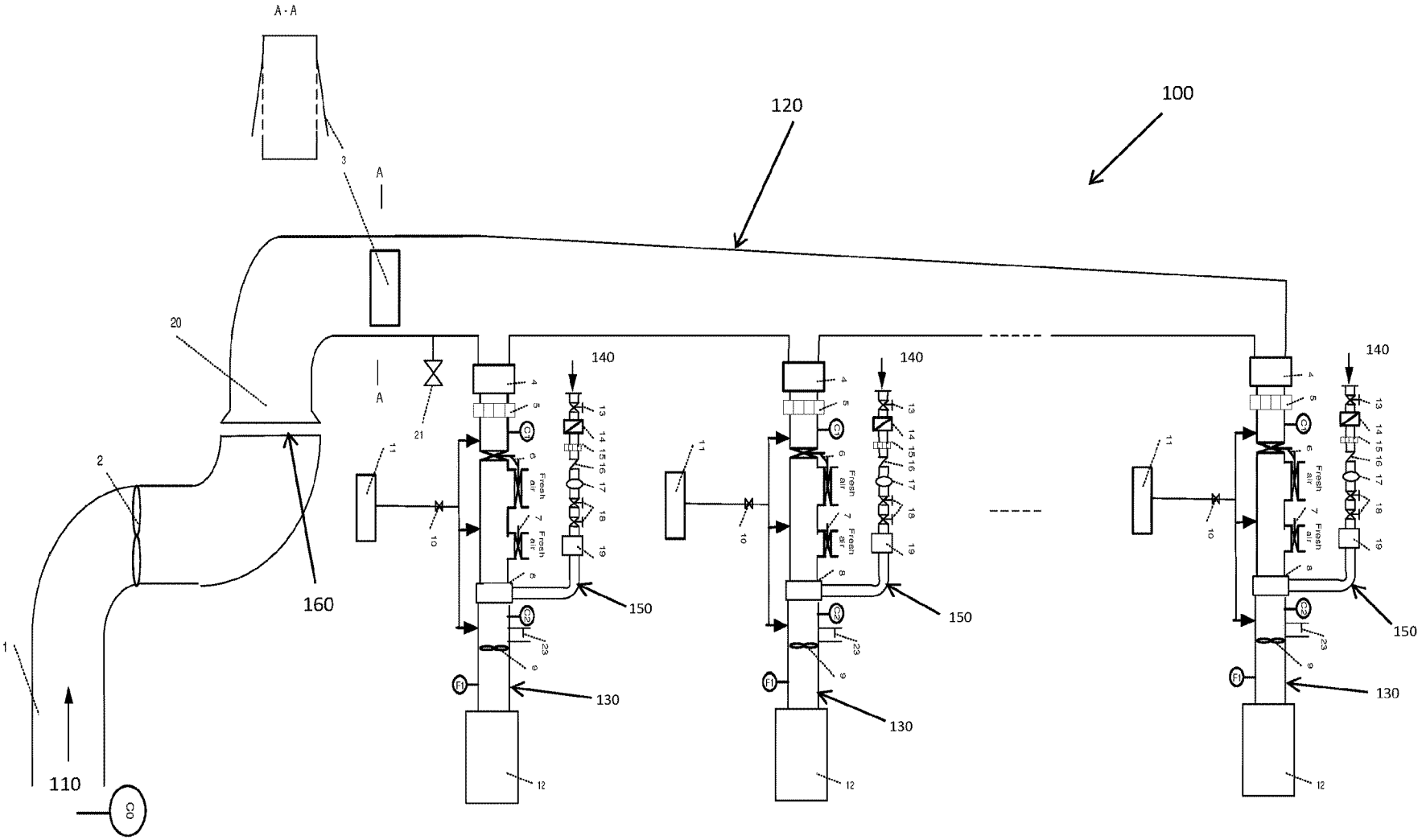
FIG. 4 is a schematic diagram of a fourth configuration of a ducting system according to the invention.

A second configuration of a ducting system is shown in FIG. 2. Configuration 2 is a similar set up to configuration 1 however some of the components of the ducting system of FIG. 1 are provided in each individual combustion module pipe 130 leading to the VAM combustion modules 12. In this way, if there is a high methane reading at sensors C0, C1, C2 in one of the combustion module pipes 130, or flame detected at flame detector F1 in one of the combustion module pipes, only the affected pipe will be shut down and the remaining VAM combustion modules 12 on unaffected pipes can continue to operate. This configuration also allows flexibility in whether some or all the VAM combustion modules 12 are provided with fuel mixing to control the methane concentration. Furthermore, with a ducting system 100 of this configuration, the maintenance, replacement or other work being conducted on components of the ducting system may only require the VAM combustion module 12 on the affected combustion module pipe to be shut down, allowing the other VAM combustion modules on the remaining combustion module pipes to continue to operate.

Configuration 3

Configuration 3 is the same as configuration 1 applied to an unenclosed ducting system 100 whereby a ventilation air hood 20 is used to collect ventilation air 110 from above a ventilation air shaft outlet 160.

Configuration 4

Configuration 4 is the same as configuration 2 applied to an unenclosed ducting system 100 whereby a ventilation air hood 20 is used to collect ventilation air 110 from above a ventilation air shaft outlet 160.

Flame Arrestors

Flame arrestors are designed to allow the flow of gas therethrough while preventing the propagation of a flame front by removal of heat from the flame as it passes through the flame arrestor. In general, there are two important regimes of explosion: deflagration and detonation. Deflagration normally propagates at a velocity below the speed of sound and the maximum pressure is 0.7 MPa. Detonation waves proceed at supersonic velocities, ranging from 1,000 m/s to 2,500 m/s with a maximum pressure up to 1.7 MPa and can cause extreme destruction that is much harder to arrest than deflagration. It is therefore very important to determine whether and how deflagration or detonation can occur for various geometries and mixture compositions of ventilation air ducting so that optimum safety requirements can be designed into the ventilation air ducting system.

In the above described ducting systems, flame arrestors 5 are positioned between the combustion modules 12 and the ventilation air shaft 1 to suppress the flame propagation back to the mine in the event that ignition of the flow of gaseous feed were to occur. Additional flame arrestors 15 are provided in the supplementary gaseous feed pipe. It will be appreciated that further flame arrestors may also be provided adjacent potential ignition sources to at least partially quench a flame should ignition occur and therefore reduce the load on the final flame arrestor 5. For example, combustion module flame arrestors may be positioned proximal to the combustion modules 12. Selection of a flame arrestor rated for deflagration and/or detonation depend on how the ducting is designed for its practical application, such as its length, diameter, shape, bends and equipment. It is important to design the ducting in a manner to minimise the likelihood of a deflagration to detonation transition (DDT) should a fire occur, for example by minimising features in the ducting that could increase turbulence of a flame, such as elbows, sensors and other attachments.

There are many types of flame arrestors. A flame arrestor for use in the safe ducting system may comprise crimped metal ribbon, parallel plate, expanded metal cartridge, perforated plate, wire gauze, sintered metal, metal shot, ceramic balls and/or compressed wire wool flame arrestor elements.

Figure 5:
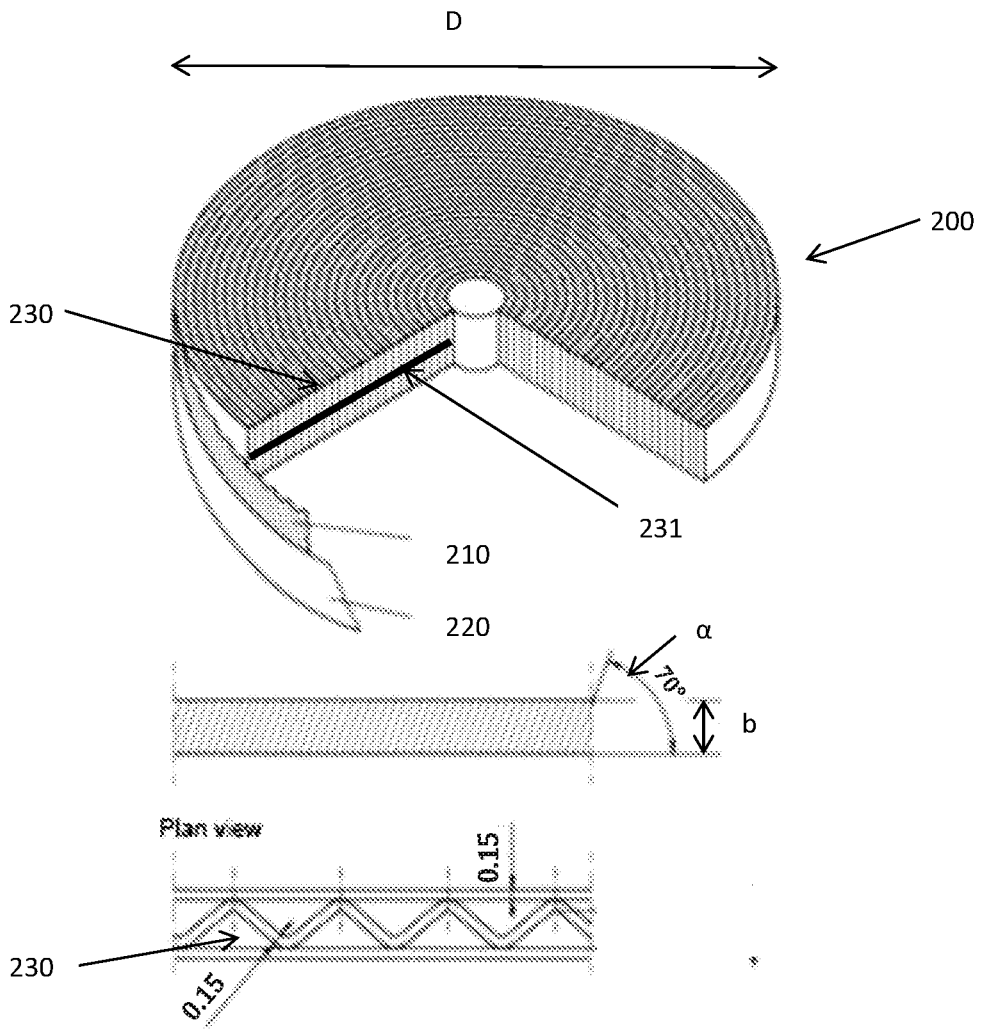
FIG. 5 is a schematic diagram of a crimped metal ribbon flame arrestor.
Figure 6:
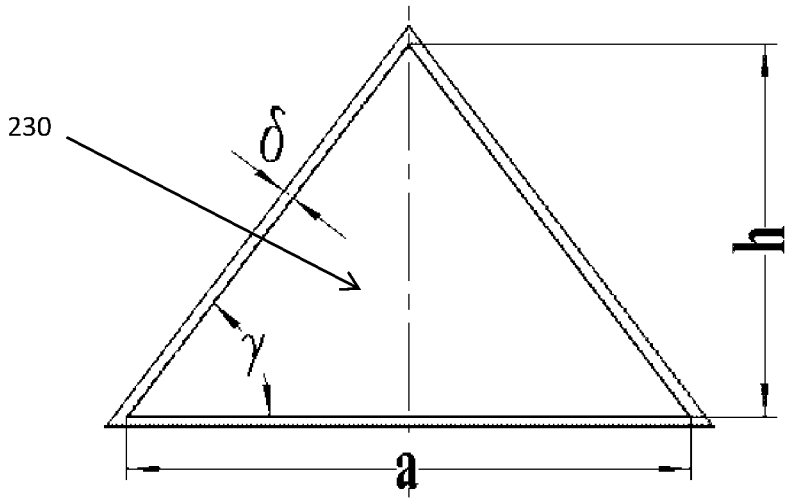
FIG. 6 is a side view of a channel of the flame arrestor of FIG. 5.

Referring to FIGS. 5 and 6, crimped metal ribbon flame arrestor elements 200 are characterised by alternating layers of crimped metal ribbons 210 and flat metal ribbons 220 which are wound together to form a layered cylinder. The spaces between the crimped and flat ribbons provide multiple small channels 230 of approximately triangular cross-section.

Crimped metal ribbon flame arrestor elements can be characterised by a number of parameters, including ribbon thickness, element thickness b and element diameter D. The channels formed in the spaces between the corrugations and the flat ribbon can be characterised by the height h and bottom side width a of the triangle, as shown in FIG. 6. The path length L is defined by the element inclination a and the element thickness b, i.e. $L=b/a$. The expansion ratio $\beta$ is defined as the ratio of the element diameter D to the pipe diameter d, i.e. $\beta=D/d$.

The design of a crimped metal ribbon flame arrestor element suitable for use in ducting between a coal mine ventilation air shaft and VAM combustion modules must take into account various features specific to the system such as flow rate of the ventilation air through the ducting, composition, dust content and pipe size.

For example, it has been found that channels of smaller cross-sectional area increases flame quenching efficiency, however smaller channels are more prone to fouling with coal dust which can lead to increased requirement for cleaning and replacement of the arrestor, potential failure of quenching and increased ventilation air flow resistance. Similarly, increased channel length L has been found to increase flame quenching efficiency, while also increasing the flow resistance. The crimped metal ribbon flame arrestor path length L may be of any suitable length, preferably from about 10 mm to about 250 mm. It will be appreciated that the path length for a system can be increased by providing two or more crimped metal ribbon arrestor elements in series.

The expansion ratio (3, the ratio of the element diameter D to pipe diameter d, can also be an important parameter. It has been found that increasing the expansion ratio, i.e. increasing the element diameter D increases the flame quenching efficiency. However, pipes used in conveying coal mine ventilation air are significantly larger than pipes for which flame arrestors are currently designed for. For example, the main duct 110 for conveying coal mine ventilation air 110 may be in the order of about 5 m in diameter. Combustion module pipes are generally significantly smaller in diameter than the main duct, for example the combustion module pipes may be around 1 m in diameter.

Preferably, the flame arrestor has an expansion ratio $\beta$ greater than about 1, preferably from about 1 to about 5, and more preferably about 2. However, increasing the element diameter D can lead to increased risk of damage during handling, installation and use with the potential for enlarged or collapsed channels which can decrease the flame quenching efficiency and increase flow resistance. To increase durability, support members may be introduced to the flame arrestor, such as metal rods, extending radially through the cylinder of the flame arrestor. Furthermore, two or more crimped metal ribbon flame arrestor elements can be provided in parallel to provide process higher ventilation air flow rates without needing to increase the diameter of the flame arrestor elements.

VAM Combustion Modules

Suitable VAM combustion modules include the system for mitigating a volatile component from a gaseous feed as described in AU 2009338680 and the system for catalytic combustion as described in U.S. Pat. No. 7,430,869, both of which are incorporated herein by reference.

Figure 7:
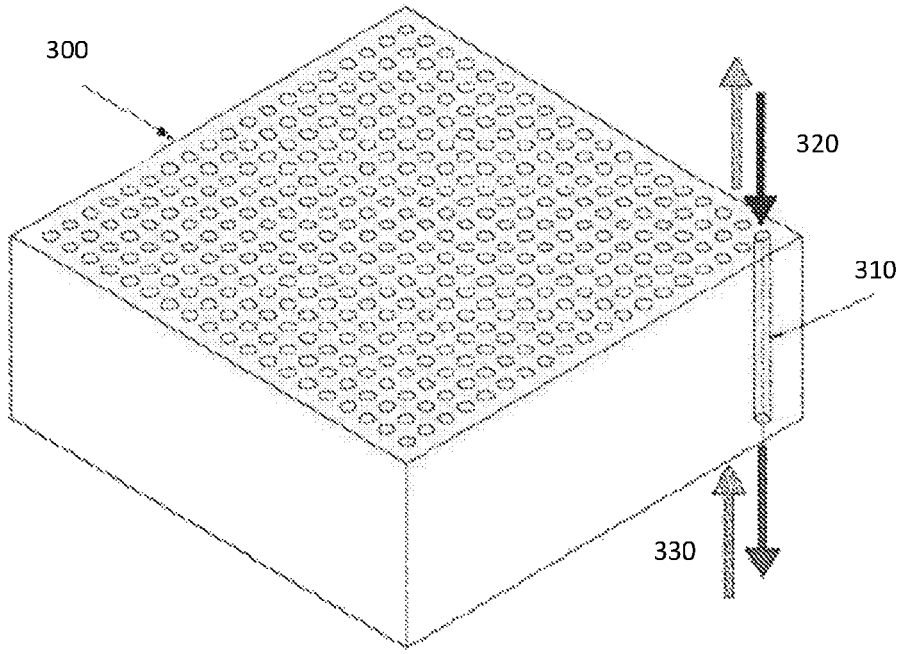
FIG. 7 is a body portion ventilation air methane (VAM) combustion module.

In certain embodiments, VAM mitigation combustion modules 12 of the type described in AU 2009338680, which is incorporated herein by reference, are used. Referring to FIG. 7, the body portion 300 of the VAM mitigation combustion module 12 includes an array of bores 310 that extend through the body portion 300 from a first end to an opposing second end. The bores 310 have a circular cross section with a diameter of 3 mm and are spaced apart at distance of approximately 4 mm taken from the centre points of the bores. The body portion is substantially cube-shaped, having a height, width and depth each of from about 1 m to about 3 m.

During start-up of the combustion module, the body portion is heated to a desired temperature, generally about 1200° C. Inclusion of a catalyst in the body portion, for example within the material of the body portion itself or applied to the walls of the bores extending therethrough, may dictate a relatively low start up temperature of from about 200° C. to about 700° C.

The ventilation air containing methane flows through the bores of the body portion. The ventilation air is initially at a temperature of about 25° C. (i.e. ambient temperature) and increases in temperature as it passes through the combustion module by absorbing heat from the inner walls of the bores until it reaches auto-ignition temperature of the methane. At this point, oxidation takes place resulting in relatively high temperature gaseous emission that provides heat to the body portion as it exits the combustion module. The direction of ventilation air flow through the body portion may be periodically reversed between a forward flow 320 and a reverse flow 330 to utilise the heat generated by the combustion process and therefore reduce the energy consumption of the combustion module 12.

In other embodiments, VAM catalytic combustion modules 12 of the type described in U.S. Pat. No. 7,430,869, which is incorporated herein by reference, may be used. VAM catalytic combustion modules 12 may include a body portion in the form of a honeycomb-type monolith catalytic combustor. The catalytic combustor may contain any suitable catalyst for the system, for example a catalyst having an activity of $50\times10^{-7}$ to $200\times10^{-7}$ mole/m$^2$s and a reaction surface area of 20 to 40 m$^2$/cm$^2$. The honeycomb-type monolith catalytic combustor may comprise a ceramic monolith which acts as a substrate for a wash coat slurry of base metals on which a noble metal catalyst is placed.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A ducting system for conveying a flow of a gaseous feed of ventilation air derived from a coal mine comprising a combustible component from an inlet to at least one combustion module, the system comprising: a shut-off valve configurable to have an open position to allow the flow of the gaseous feed from the inlet to the at least one combustion module and a closed position to prevent the flow of the gaseous feed from the inlet to the at least one combustion module; a sensor to measure a concentration of the combustible component in the flow of the gaseous feed, the sensor located upstream of the shut-off valve; a flame detector located downstream of the shut-off valve; a flame arrestor located in a flow path of the gaseous feed upstream of the shut-off valve; and a source of fire retardant and a fire retardant valve feeding one or more fire retardant injection points for controlling flow of the fire retardant into the ducting system, the one or more fire retardant injection points positioned between the flame arrestor and the at least one combustion module, wherein the shut-oft valve is operatively associated with the sensor such that a measurement of a concentration of the combustible component in flow of the gaseous feed over a specified concentration by the sensor causes the shut-off valve to be configured to the closed position for preventing flow of a gaseous feed comprising a combustible mixture of the combustible component from reaching an ignition source, wherein the specified concentration is 1.25% methane as the combustible component wherein the shut-off valve is operatively associated with the flame detector such that detection of flame by the flame detector causes the shut-off valve to be configured to the closed position for attenuating propagation of a flame toward the inlet, and wherein the fire retardant valve is operatively associated with the flame detector such that detection of flame by the flame detector causes the fire retardant valve to open allowing the tire retardant to flow into the ducting system for attenuating the detected flame; further comprising a supplementary gaseous feed comprising a supplementary combustible component and a supplementary gaseous feed valve for controlling flow of supplementary gaseous feed into the flow of the gaseous feed downstream of the shut-off valve, wherein the supplementary gaseous feed is in fluid communication with a gas mixer for mixing the gaseous feed with the supplementary gaseous feed.

2. A ducting system for conveying a flow of a gaseous feed of ventilation air derived from a coal mine comprising a combustible component from an inlet to at least one combustion module, the system comprising: a sensor to measure a concentration of the combustible component in the flow of the gaseous feed; a flame detector; a shut-off valve configurable to have an open position to allow the flow of the gaseous feed from the inlet to the at least one combustion module and a closed position to prevent the flow of the gaseous feed from the inlet to the at least one combustion module; and a flame arrestor located in a flow path of the gaseous feed upstream of the shut-oft valve, wherein the shut-off valve is operatively associated with the sensor such that a measurement of a concentration of the combustible component in flow of the gaseous feed over a specified concentration by the sensor causes the shut-off valve to be configured to the closed position for preventing flow of a gaseous feed comprising a combustible mixture of the combustible component from reaching an ignition source, wherein the specified concentration is 1.25% methane as the combustible component; and wherein the shut-off valve is operatively associated with the flame detector such that detection of flame by the flame detector causes the shut-off valve to be configured to the closed position for attenuating propagation of a flame toward the inlet; further comprising a supplementary gaseous feed comprising a supplementary combustible component and a supplementary gaseous feed valve for controlling flow of supplementary gaseous feed into the flow of the gaseous feed downstream of the shut-off valve, wherein the supplementary gaseous feed is in fluid communication with a gas mixer for mixing the gaseous feed with the supplementary gaseous feed.

3. The system according to claim 2, wherein the sensor is located between the inlet and the shut-off valve at a position such that the shut-off valve can be configured to the closed position prior to a portion of the gaseous feed, comprising the combustible component at a concentration over the specified concentration as measured by the sensor, flowing to the shut-off valve.

4. The system according to claim 3, wherein the first sensor is positioned proximal to a source of the gaseous feed.

5. The system according to claim 2, wherein the at least one combustion module is shut down to remove the combustion module as a potential ignition source upon measurement of a concentration of the combustible component in the flow of the gaseous feed over the specified concentration by the sensor and/or detection of flame by the flame detector.

6. The system according to claim 2, further comprising a combustion module flame arrestor located proximal each of the at least one combustion modules.

7. The system according to claim 2 wherein the flame arrestor comprises a crimped metal ribbon flame arrestor element.

8. The system according to claim 7, wherein the crimped metal ribbon flame arrestor element has an expansion ratio greater than 1.

9. The system according to claim 7, wherein the crimped metal ribbon flame arrestor element comprises a path length of from 10 mm to 250 mm.

10. The system according to claim 2, further comprising a first source of fresh air and a first fresh air valve for controlling flow of the first source of fresh air into the ducting system, wherein the first fresh air valve is operatively associated with the shut-off valve such that when the shut-off valve is configured to the closed position, the first fresh air valve is in an open position to allow flow of fresh air into the system for diluting the concentration of the combustible component.

11. The system according to claim 2, wherein at least one fire retardant injection point is positioned upstream of the shut-off valve and at least one fire retardant injection point is positioned downstream of the shut-off valve.

12. The system according to claim 2, further comprising one or more burst panels located upstream of the at least one combustion module and downstream of at least one fire retardant injection point.

13. The system according to claim 2, further comprising a second source of fresh air and a second fresh air valve for controlling flow of the second source of fresh air into the flow of the gaseous feed at a position upstream of the mixer.

14. The system according to claim 13, further comprising a pair of supplementary sensors to measure a concentration of the combustible component in the flow of the gaseous feed, wherein the pair supplementary sensors comprise one supplementary sensor positioned upstream of the mixer and another supplementary sensor positioned downstream of the mixer and wherein the pair of supplementary sensors are operatively associated with the second fresh air valve and the supplementary gaseous feed valve for controlling the concentration of the combustible component in the flow of the gaseous feed leaving the mixer.

15. The system according to claim 2, further comprising a ventilation air filter for filtering coal dust from the ventilation air.

16. The system according to claim 15, wherein the ventilation air filter is positioned upstream relative to the flame arrestor.

17. A ducting system for conveying a flow of a gaseous feed of ventilation air derived from a coal mine comprising a combustible component from an inlet to at least one combustion module, the system comprising:

a shut-off valve configurable to have an open position to allow the flow of the gaseous feed from the inlet to the at least one combustion module and a closed position to prevent the flow of the gaseous feed from the inlet to the at least one combustion module;

a sensor to measure a concentration of the combustible component in the flow of the gaseous feed, the sensor located upstream of the shut-off valve;

a flame detector located downstream of the shut-off valve;

a flame arrestor located in a flow path of the gaseous feed upstream of the shut-off valve;

a source of fire retardant and a fire retardant valve feeding one or more fire retardant injection points for controlling flow of the fire retardant into the ducting system, the one or more fire retardant injection points positioned between the flame arrestor and the at least one combustion module;

a supplementary gaseous feed in fluid communication with a gas mixer for mixing the gaseous feed with the supplementary gaseous feed, the supplementary gaseous feed comprising a supplementary combustible component;

a supplementary gaseous feed valve for controlling flow of supplementary gaseous feed into the flow of the gaseous feed downstream of the shut-off valve;

a source of fresh air and a fresh air valve for controlling flow of the source of fresh air into the flow of the gaseous feed at a position upstream of the mixer; and a pair of supplementary sensors to measure a concentration of the combustible component in the flow of the gaseous feed, wherein the pair of supplementary sensors comprise one supplementary sensor positioned upstream of the mixer and another supplementary sensor positioned downstream of the mixer, wherein the shut-off valve is operatively associated with the sensor such that a measurement of a concentration of the combustible component in flow of the gaseous feed over a specified concentration by the sensor causes the shut-off valve to be configured to the closed position for preventing flow of a gaseous feed comprising a combustible mixture of the combustible component from reaching an ignition source, wherein the specified concentration is 1.25% methane as the combustible component, wherein the shut-off valve is operatively associated with the flame detector such that detection of flame by the flame detector causes the shut-off valve to be configured to the closed position for attenuating propagation of a flame toward the inlet, wherein the fire retardant valve is operatively associated with the flame detector such that detection of flame by the flame detector causes the fire retardant valve to open allowing the fire retardant to flow into the ducting system for attenuating the detected flame, and wherein the pair of supplementary sensors are operatively associated with the second fresh air valve and the supplementary gaseous feed valve for controlling the concentration of the combustible component in the flow of the gaseous feed leaving the mixer.

* * * * *